United States Patent [19]

Miyakawa et al.

[11] 4,150,387

[45] Apr. 17, 1979

[54] ALTERNATING CURRENT ELECTROSTATIC RECORDING PROCESS

[75] Inventors: Nobuhiro Miyakawa, Kobe; Takashi Yamaguchi, Yokohama; Eiichi Inoue, Tokyo, all of Japan

[73] Assignee: Mita Industrial Company Ltd., Osaka, Japan

[21] Appl. No.: 845,214

[22] Filed: Oct. 25, 1977

[30] Foreign Application Priority Data

Oct. 27, 1976 [JP] Japan ..... 51-129026

[51] Int. Cl.[2] ..... G03G 15/00

[52] U.S. Cl. ..... 346/153; 346/164

[58] Field of Search ..... 346/153, 154, 164, 165

[56] References Cited

U.S. PATENT DOCUMENTS

| | | | |
|---|---|---|---|
| 2,251,742 | 8/1941 | Kline | 346/164 |
| 3,493,427 | 2/1970 | Takagi | 346/153 |
| 3,622,468 | 11/1971 | Turner | 346/165 |
| 3,831,179 | 8/1974 | Brill | 346/153 |
| 3,967,959 | 7/1976 | Goffe et al. | 346/153 |

*Primary Examiner*—Jay P. Lucas

*Attorney, Agent, or Firm*—Sherman & Shalloway

[57] ABSTRACT

In the electrostatic recording process comprising relatively scanning a recording electrode on an electrostatic recording material electrically connected between said recording electrode and a counter electrode, applying a high frequency alternating current or asymmetric alternating current recording signal formed by amplifying and modulating an image signal by a high frequency carrier wave between said two electrodes to form an electrostatic image on the electrostatic recording material, developing the so formed electrostatic image with a developer and, if desired, fixing the developed image, when an electrostatic recording material including an electroconductive substrate having a specific multilayer distribution structure is used and if a dielectric layer is disposed on this electroconductive substrate in a specific arrangement selected according to the kind of the recording signal to be applied, such problems as blurring, tailing and fogging can be effectively eliminated and recorded images excellent in the density and sharpness can be obtained without substantial influences of the humidity in the recording atmosphere.

15 Claims, 11 Drawing Figures

Fig. 4-A
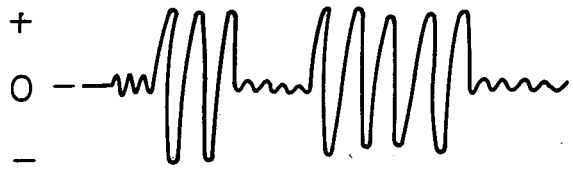
Fig. 5-A
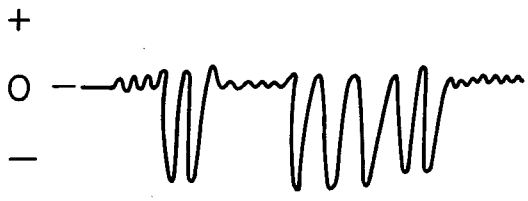
Fig. 6-A
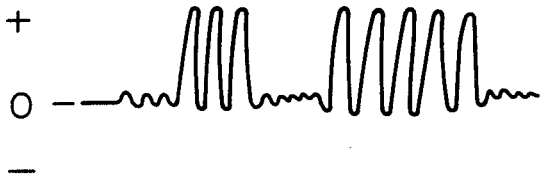

Fig. 4-B
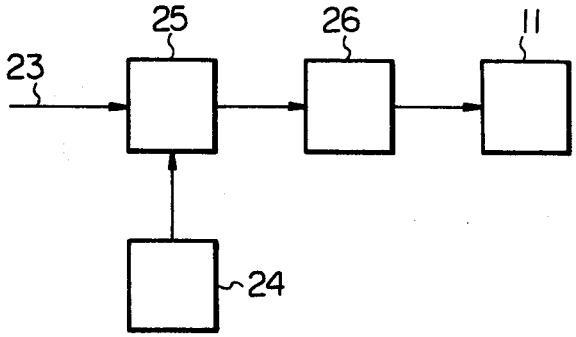
Fig. 5-B
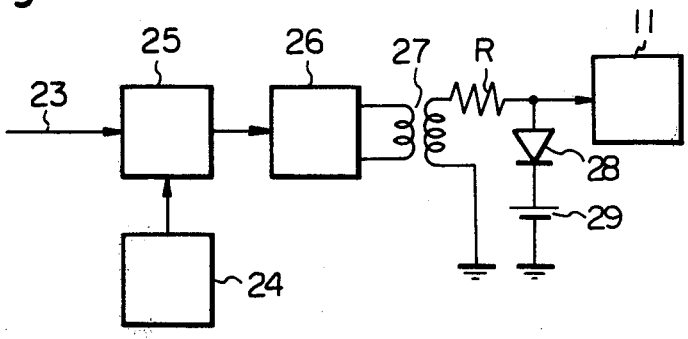
Fig. 6-B
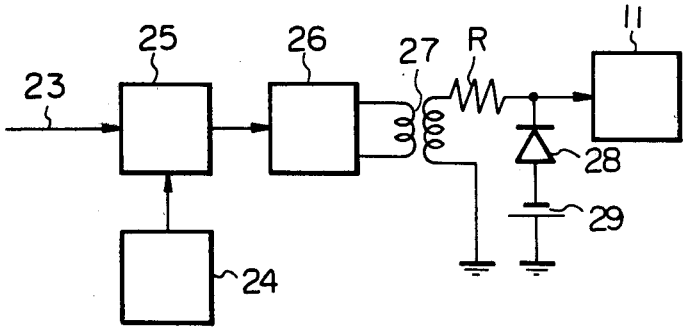

ALTERNATING CURRENT ELECTROSTATIC RECORDING PROCESS

BACKGROUND OF THE INVENTION (1) Field of the Invention

The present invention relates to an alternating current electric recording process. More particularly, the present invention relates to an alternating current electric recording process in which by applying as electric recording signals high frequency alternating current or asymmetric alternating current signals formed by amplifying and modulating image signals and using an electrostatic recording material comprising an electroconductive substrate having a specific multilayer distribution structure, such problems as blurring, tailing and fogging can be effectively eliminated and recorded images excellent in the density and sharpness can be formed without substantial influences of the humidity in the recording atmosphere.

(2) Description of the Prior Art

As the conventional electric recording process, there is known a so-called electrostatic recording process comprising moving relatively a pair of a recording electrode and a counter electrode and an electrostatic recording material electrically connected between the two electrodes, applying an electric recording signal between the two electrodes to form an electrostatic latent image on the electrostatic recording material, developing the so formed electrostatic latent image with a developer and, if desired, fixing the developed image.

In general, direct current signals are used as the electric recording signal to be applied in this known electrostatic recording process. However, a high-voltage direct current applied to a recording stylus not only forms a latent image on the recording surface but also causes such problems as so-called "blurring", "tailing" and "fogging". For example, Messrs. Haneda, Ito and Hashigami teach that simultaneously with formation of a latent image as mentioned above, charges of the opposite polarity, which are deemed to be due to influences of induction or electric force lines, are accumulated in the vicinity of the latent image to cause "blurring", when the recording stylus is moved, charges accumulated on the recording stylus and other recording equipments are applied and transferred to the recording surface to cause "tailing". Because of the potential forming the latent image, the entire recording surface is charged at the same polarity as that of the latent image, though the intensity of charging is lower than in the latent image and this charging results in "fogging" (see the Journal of the Electrophotographic Association, April 1970, pages 37 to 43). Accordingly, in a final image obtained by the electrostatic recording process using a high-voltage direct current as the electric recording signal, the resolving power is reduced by the above-mentioned undesirable phenomena such as blurring, tailing and fogging and the image becomes obscure. Further, when recording is carried out at a high speed, namely when the relative scanning speed of the recording stylus and recording material is enhanced, the above defect becomes especially conspicuous.

Methods using as electric recording signals high frequency signals formed by amplifying and modulating image signals have already been proposed in Japanese Patent Publications Nos. 33516/71 and 21311/65. It is taught that according to the method disclosed in the former patent publication, since charges of different polarities are alternately applied, charges oriented in the vertical direction of a recording paper are not formed and a powdery developer is uniformly stuck to either the peripheral portion or the central portion of a latent image on the recording paper, whereby the edge effect is eliminated and an image of good quality is obtained. The latter patent publication discloses that according to the claimed alternating current recording method, the entire circuit structure can be simplified, any developer can be used irrespective of the polarity of the toner and an image having a sufficient resolving power is obtained.

Images obtained according to the known alternating current recording methods, however, are still insufficient in the density and sharpness, and therefore, these alternating current recording methods have not been satisfactory.

Still further, the known electrostatic recording methods are defective in that electrostatic recording materials are readily influenced by the humidity in the recording atmosphere. In general, recording materials comprising an electroconductive substrate and a dielectric layer formed thereon have been used as electrostatic recording materials, but in each of the known electroconductive layers, the electroconductivity is considerably influenced by the humidity and no sufficient conductivity can be obtained unless under considerably high humidity conditions. Accordingly, in the conventional electrostatic recording materials, it is difficult to charge the dielectric layer to a sufficient recording voltage under low humidity conditions and hence, it is ordinarily difficult to form images having a high density. This tendency is especially conspicuous when such electrostatic recording materials are used for the above-mentioned alternating current recording process and serious problems arise with respect to the absolute density and contrast in recorded images.

BRIEF SUMMARY OF THE INVENTION

We previously found that when one surface of a porous substrate such as paper or a porous substrate impregnated with a water-soluble inorganic salt or an organic moisture-absorbing substance is coated or impregnated with a cationic electroconductive resin and the other surface of the porous substrate is coated or impregnated with an anionic electroconductive resin, there is formed an electroconductive substrate having a novel multi-layer distribution structure in which, it is believed, the cationic electroconductive resin is distributed predominantly on one surface of the porous substrate, the anionic electroconductive resin is distributed predominantly on the other surface of the porous substrate and a polymeric electrolytic complex (polysalt) is formed in the interface between them. It was also found that this electroconductive substrate has various novel and prominent electric characteristics.

As a result of our research works further made in this field, it was found that when electrostatic recording is carried out by using high frequency alternating current or asymmetric alternating current recording signals formed by amplifying and modulating image signals, if a dielectric layer is disposed on an electroconductive substrate having the above-mentioned novel multi-layer distribution structure in a specific arrangement selected according to the kind of the recording signal to be applied, such problems as blurring, tailing and fogging can be effectively eliminated and recorded images excellent in the density and sharpness can be obtained without substantial influences of the humidity in the recording atmosphere.

More specifically, in accordance with one fundamental aspect of the present invention, there is provided an alternating current electric recording process comprising relatively moving a pair of a recording electrode and a counter electrode and an electrostatic recording material electrically connected between said two electrodes, applying a high frequency alternating current or asymmetric alternating current recording signal formed by amplifying and modulating an image signal by a high frequency carrier wave between said two electrodes to form an electrostatic image on the electrostatic recording material, developing the so formed electrostatic image with a developer and, if desired, fixing the developed image, said process being characterized in that said electrostatic recording material comprises an electroconductive layer and a dielectric layer, said electroconductive layer includes a porous substrate, a cationic electroconductive resin layer predominantly distributed on one surface of said porous substrate, an anionic electroconductive resin layer predominantly distributed on the other surface of said porous substrate and a layer of a polycomplex of the cationic electroconductive resin and the anionic electroconductive resin impregnated in said substrate and interposed between said two electroconductive resin layers, and that when the recording signal is an alternating current signal or a signal of an asymmetric alternating current biassed to the negative porality side, the dielectric layer is disposed on the side of the anionic electroconductive resin layer and when the recording signal is a signal of an asymmetric alternating current biassed to the positive polarity side, the dielectric layer is disposed on the side of the cationic electroconductive resin layer.

BRIEF DESCRIPTION OF THE DRAWING

FIG. 3-A is a view illustrating the electrostatic latent image-forming step in the recording process of the present invention.

FIG. 3-B is a view illustrating the developing step in the recording process of the present invention.

FIG. 3-C is a view illustrating the fixing step in the recording process of the present invention.

FIG. 4-A is a diagram illustrating the wave form of an alternating current recording signal.

FIG. 4-B is a block diagram illustrating an output circuit for producing the recording signal shown in FIG. 4-A.

FIG. 5-A is a diagram illustrating the wave form of a recording signal of an asymmetric alternating current biassed to the negative polarity side.

FIG. 5-B is a block diagram illustrating an output circuit for producing the recording signal shown in FIG. 5-A.

FIG. 6-A is a diagram illustrating the wave form of a recording signal of an asymmetric alternating current biassed to the positive polarity side.

FIG. 6-B is a block diagram illustrating an output circuit for producing the recording signal shown in FIG. 6-A.

DETAILED DESCRIPTION OF THE PREFERRED EMBODIMENTS

The electric recording process of the present invention will now be described in detail.

[Electroconductive Substrate]

Figure 1:
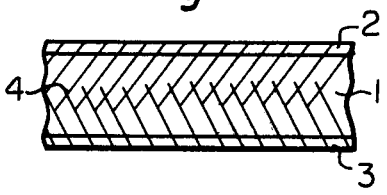
FIG. 1 is a sectional view illustrating diagrammatically an example of the electroconductive substrate having a multi-layer distribution structure, which is used in the present invention.

Referring now to FIG. 1 illustrating diagrammatically one instance of the electroconductive substrate that is used in the present invention, one surface of a porous substrate 1 is coated or impregnated with a cationic electroconductive resin 2, and the other surface is coated or impregnated with an anionic electroconductive resin 3. As indicated by oblique lines in the drawing, these cationic and anionic electroconductive resins 2 and 3 permeate into the interior of the porous substrate 1, and in the interface between both the resins, a polymeric electrolytic complex (polysalt) 4 is formed by the reaction between both resins. From FIG. 1, it will readily be understood that this electroconductive substrate has a multi-layer distribution structure comprising a first surface layer composed of the cationic electroconductive resin 2, a second surface layer composed of the anionic electroconductive resin 3 and an intermediate layer composed of the polysalt 4, which is interposed between the first and second surface layers.

Figure 2:
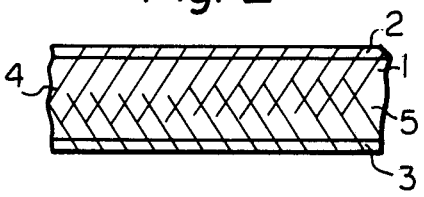
FIG. 2 is a sectional view illustrating diagrammatically another example of the electroconductive substrate having a multi-layer distribution structure, which is used in the present invention.
Figure 2:
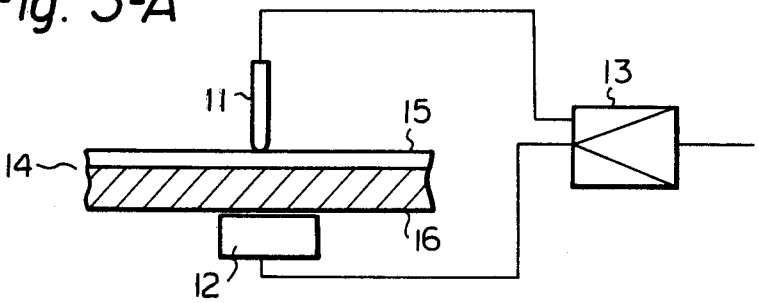
Figure 2:
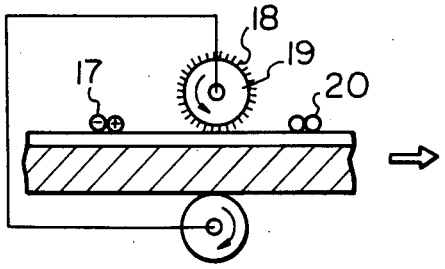
Figure 2:
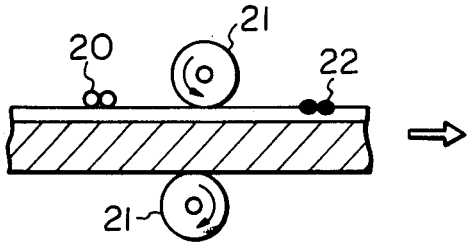

Referring now to FIG. 2 illustrating diagrammatically another instance of the electroconductive substrate that is used in the present invention, the entire of a porous substrate 1 is impregnated with a water-soluble inorganic salt or organic moisture-absorbing substance 5, and one surface of the impregnated porous substrate 1 is impregnated or coated with a cationic electroconductive resin 2 and the other surface is impregnated or coated with an anionic electroconductive resin 3. As in the case of the electroconductive substrate shown in FIG. 1, a multi-layer distribution structure is manifested in this electroconductive substrate shown in FIG. 2.

As the porous substrate, not only ordinary papers composed of cellulose fibers, such as tissue papers, art papers and base papers for copying papers, but also synthetic papers prepared by subjecting synthetic fiber staples or fibrils to the paper-making process or foaming synthetic resin films, woven and knitted fabrics prepared by weaving or knitting natural, regenerated or synthetic fibers and non-woven fabrics can be used in this invention, so far as they have a form of porous and thin sheet allowing solutions of electroconductive resins to permeate thereinto.

As the cationic electroconductive resin to be applied to one surface of the porous substrate and used for formation of a polysalt, there are preferably employed resinous electrolytes having a quaternary ammonium group on the main or side chain. Preferred examples of such resinous electrolytes are as follows:

(1) Resins having a quaternary ammonium group in the aliphatic main chain, such as quaternized polyethylene imines and ditertiary amine-dihalide condensates, e.g., ionenes.

(2) Resins containing a quaternary amino group as one member in the cyclic main chain, such as polypyrazine, quaternized polypiperazine, poly(dipyridyl) and 1,3-di4-pyridyl propane-dihaloalkane condensates.

(3) Resins having a quaternary ammonium group on the side chain, such as poly(vinyltrimethyl ammonium chloride) and poly(allytrimethyl ammonium chloride).

(4) Resins containing a quaternary ammonium group as the side chain on the cyclic main chain, such as resins consisting of recurring units represented by the following formula:

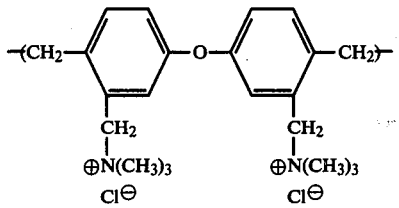

(5) Resins having a quaternary ammonium group on the cyclic side chain, such as poly(vinylbenzyltrimethyl ammonium chloride).

(6) Resins having a quaternary ammonium side chain on the acrylic skeleton, such as quaternary acrylic esters, e.g., poly(2-acryloxyethyltrimethyl ammonium chloride) and poly(2-hydroxy-3-methacryloxypropyltrimethyl ammonium chloride), and quaternary acrylamides, e.g., poly(N-acrylamidopropyl-3-trimethyl ammonium chloride).

(7) Resins having a quaternary ammonium group in the heterocyclic side chain, such as poly(N-methylvinylpyridinium chloride) and poly(N-vinyl-2,3-dimethylimidazolinium chloride).

(8) Resins containing a quaternary ammonium group in the heterocyclic main chain, such as poly(N,N-dimethyl-3,5-methylene piperidium chloride) and copolymers thereof.

In the present invention, in addition to the foregoing resins having a quaternary ammonium group on the main chain or side chain, there can be used, as cationic electroconductive resins, resins having a sulfonium group

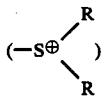

or phosphonium group

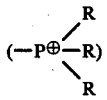

on the main or side chain, such as poly(2-acryloxyethyldimethyl sulfonium chloride) and poly(glycidyltributyl phosphonium chloride).

Since the cationic electroconductive resin that is used in the present invention has on the main or side chain a highly basic group such as a quaternary ammonium group, a sulfonium group or a phosphonium group, it should naturally have a low-molecular-weight monovalent anion as the counter-ion. The surface resistance of the cationic electroconductive resin is considerably influenced by the kind of this counter-ion. As the counter-ion, there can be mentioned a chloride ion, an acetic acid ion, a nitric acid ion and a bromide ion in an order of the importance.

As the anionic electroconductive resin that is applied to the other surface of the porous substrate and used for formation of a polysalt, there are employed thermoplastic resins having a carboxyl, sulfonic or phosphonic group on the side chain. Preferred examples of such anionic electroconductive resins are as follows:

(1) Electroconductive resins of the carboxylic acid type such as polyacrylic acid salts, polymethacrylic acid salts, maleic acid-acrylic acid copolymer salts and maleic acid-vinyl ether copolymer salts.

(2) Electroconductive resins of the sulfonic acid type such as polystyrene sulfonic acid salts, polyvinyltoluene sulfonic acid salts and polyvinyl sulfonic acid salts.

(3) Electroconductive resins of the phosphonic acid type such as polyvinyl phosphonic acid salts.

These anionic electroconductive resins may be used in the form of a free acid, but it is generally preferred that they be used in the form of a salt with a counter-ion consisting of a low-molecular-weight monovalent cation. As the counter-ion, there can be mentioned, for example, metals of Group I of the Periodic Table such as Na, K, Li, Rb and Cs, and ammonium and organic bases such as dimethylamine, trimethylamine, tributylamine, dimethylaniline, tetramethyl ammonium, pyridine, monoethanolamine, diethanolamine, triethanolamine and melamine. Counter-ions especially preferred for attaining the objects of the present invention include alkali metals such as sodium and ammonium, and it is preferred that the anionic electroconductive resin be used in the form of a salt with a counter-ion such as mentioned above.

As the above-mentioned inorganic water-soluble salt, there can be exemplified halides of alkali metals, alkaline earth metals, zinc, aluminum and ammonium, such as sodium chloride, potassium chloride, sodium bromide, potassium bromide, lithium bromide, calcium chloride, barium chloride, magnesium chloride, zinc chloride, aluminum chloride and ammonium chloride, nitrates and nitrites of alkali metals, alkaline earth metals, zinc, aluminum and ammonium, such as sodium nitrate, potassium nitrate, sodium nitrite, potassium nitrite, barium nitrate, magnesium nitrate, zinc nitrate, aluminum nitrate and ammonium nitrate, sulfates, sulfites and thiosulfates of alkali metals and ammonium, such as Glauber's salt, potassium sulfate, ammonium sulfate and sodium thiosulfate, carbonates and bicarbonates of alkali metals and ammonium such as sodium carbonate, potassium carbonate and ammonium carbonate, and oxyacid salts of alkali metals and ammonium, such as sodium orthophosphate and sodium metaphosphate. These inorganic salts may be used singly or in the form of mixtures of two or more of them.

As the organic moisture-absorbing substance, there can be mentioned, for example, water-soluble polyhydric alcohols such as glycerin, diethylene glycol, triethylene glycol, polyethylene glycol, sorbitol, mannitol, pentaerythritol, cyanized starch and polyvinyl alcohol. These organic moisture-absorbing substances can be used singly or in combination with water-soluble inorganic salts such as mentioned above.

When the porous substrate is impregnated with a water-soluble inorganic salt or an organic moistureabsorbing substance (generally a polyhydric alcohol), in general, an aqueous solution of a water-soluble inorganic salt and/or an organic moisture-absorbing substance is prepared, the porous substrate is dipped in this aqueous solution, and liquid-removing and drying treatments are then conducted according to need. In general, it is preferred that the amount coated of the water-soluble inorganic salt be 1 to 15 g/m$^2$, especially 3 to 10 g/m$^2$, on the dry basis, though the preferred amount coated varies to some extent depending on the kind and thickness of the porous substrate and the kind of the water-soluble inorganic salt.

Although the amounts coated of the cationic and anionic electroconductive resins are changed to some extent depending on the kinds of the resins, it is generally preferred that the amount coated of each resin be 0.5 to 10 g/m$^2$, especially 1to 7 g/m$^2$, on the dry basis.

In the electroconductive substrate that is used in the present invention, the amount ($D_C$) coated of the cationic electroconductive resin and the amount ($D_A$) coated of the anionic electroconductive resin may be equal or different. In general, it is preferred that the ratio ($D_C/D_A$) of the coated amounts of both the resins be within a range of from 0.4 to 2.2, especially from 0.6 to 1.5.

It is important that the cationic and anionic electroconductive resins should be coated and impregnated so that a polysalt of both the resins, namely a polymeric electrolytic complex, is formed in the interface between both the resin layers.

From this viewpoint, it is preferred that at least a solution of an electroconductive resin to be applied at the final stage, especially both the solutions of cationic and anionic electroconductive resins, be an aqueous solution. As the aqueous medium, not only water but also a mixture of water with a water-miscible organic solvent such as methanol, ethanol, dimethylsulfamide, dimethylsulfoxide, acetone or the like can be used. When a mixture of water with a water-miscible organic solvent such as methanol, acetone or the like is used as the aqueous medium, the permeability of the resin solution into the porous substrate is improved and a better finish can be imparted to the coated surface. It is generally recommended to use a mixture comprising at least 10% by volume of water and up to 90% by volume of a water-miscible organic solvent.

The concentration of the electroconductive resin in the solution to be applied is selected so that good adaptability to the coating operation and sufficient permeation of the resin into the porous substrate can be attained. In general, it is preferred that the concentration of the electroconductive resin be 1 to 30% by weight, especially 5 to 15% by weight, as calculated as the solid. It is possible to incorporate into the above resin solution a water-soluble inorganic salt or organic moisture-absorbing substance or to incorporate into the resin solution a binder such as starch, polyvinyl alcohol, a polyvinyl acetate emulsion, a synthetic rubber, a latex or the like or a filler such as titanium dioxide, finely divided silica, alumina, satin white or the like. From the viewpoint of the adaptability to the coating or impregnation operation, it is preferred to adopt a method in which a solution of a cationic or anionic electroconductive resin is coated on one surface of a porous substrate, the coated surface is then dried, a solution of the other electroconductive resin is coated on the other surface of the porous substrate and the coated surface is dried to form an electroconductive substrate. When this method is adopted, it is advantageous to perform the aging treatment at a temperature of 15 to 30° C. for 0.5 to 3 hours after completion of the coating operation of the second stage, whereby formation of a polyion complex (polysalt) in the interface of both the resins is remarkably promoted and enhanced. When the above method is worked on an industrial scale, however, since the drying operation is carried out under the substantially same conditions as the above-mentioned aging conditions, the aging treatment is generally omitted. In order to promote formation of a polyion complex in the interface, it is also preferred to dry the primarily coated surface so that the water content in the primarily coated resin solution is 5 to 10% and then, apply the remaining resin solution to the other surface.

This novel multi-layer distribution structure in the so formed electroconductive substrate of the present invention has a novel property that the electric conductivity is especially high selectively in a specific direction, and it is also characterized in that the electric conductivity, especially at a low humidity, is higher than in the conventional electroconductive substrates.

The electric resistance (volume intrinsic resistivity) of this electroconductive substrate can be appropriately adjusted to a level suitable for electrostatic recording, e.g., $10^5$ to $10^{10}$ Ω-cm, depending on its intended use by changing the kinds of both the electroconductive resins, the combination of the two resins, the amounts coated of the two resins, or the kind or amount of the water-soluble inorganic salt or organic moisture-absorbing substance.

[Electrostatic Recording Material]

In the present invention, dielectric substances customarily used for electrostatic recording materials of this type can be used for formation of the dielectric layer. For example, layers having a thickness of 5 to 15 μ and being composed of members selected from vinyl chloride-vinyl acetate copolymers, methacrylic resins, vinyl ether resins, vinyl acetate-crotonic acid resins, styrene polymers, acrylic resins, silicone resins, styrene-butadiene copolymers, chlorinated rubbers, alkyd resins and cellulose derivatives may be used as the dielectric layer in the present invention.

One of the important features of the present invention resides in the novel finding that in the case where (a) when the recording signal to be applied is a signal of an alternating current or asymmetric alternating current biassed to the negative polarity side, the dielectric layer is disposed on the side of the anionic electroconductive resin of the electroconductive substrate or (b) when the recording signal to be applied is a signal of an asymmetric alternating current biassed to the positive polarity side, the dielectric layer is disposed on the side of the cationic electroconductive resin of the electroconductive substrate, the density of the resulting image can be remarkably enhanced. More specifically, as illustrated in Examples 1 and 6 given hereinafter, when the above-mentioned arrangement (a) is adopted in case of a recording signal of an alternating current or asymmetric electric current biassed to the negative polarity side, a much higher density can be obtained than the image density attained when the reverse arrangement is adopted or an arrangement of a known recording material is adopted. Further, as illustrated in Example 2 given hereinafter, when the above-mentioned arrangement (b) is adopted in case of a signal of an asymmetric alternating current biassed to the positive polarity side, a much higher image density can be obtained than the image density attained when the reverse arrangement or known arrangement is adopted.

Moreover, as is apparent from results shown in Table 1-B in Example 1, this tendensy becomes conspicuous under low humidity conditions. More specifically, when the arrangement of the electroconductive substrate having a multi-layer distribution structure and the dielectric layer, as specified in the present invention, is employed, even if the relative humidity is reduced from 68% to 40%, reduction of the image density is very slight, whereas when the reverse arrangement or known arrangement of the electroconductive substrate and dielectric layer is adopted, the image density is drastically reduced by the above reduction of the relative humidity.

The reason why such excellent effect can be attained according to the present invention has not been completely elucidated. However, it is believed that such excellent effect will probably be due to the fact that in the electroconductive substrate having a multi-layer distribution structure, that is used in the present invention, when the cationic resin-coated surface is disposed on the positive electrode side and the anionic resin-coated surface is disposed on the negative electrode side, a much higher electric conductivity can be attained than in case of the reverse arrangement or when the cationic or anionic resin is used singly and this high conductivity has a very low dependency on the humidity. Because of this characteristic property, when the electrostatic recording material specified in the present invention is employed, an electrostatic image having a high recording charge of a specific polarity determined depending on the recording signal can be formed on the surface of the dielectric layer, and as a result, an image having a high density can be obtained by development of such electrostatic image.

The reason why an alternating current, namely a symmetric alternating current, is treated as being equivalent to an asymmetric alternating current biased to the negative polarity side is that also in case of a symmetric alternating current, in general, the surface of the dielectric layer is predominantly charged to a negative polarity.

In accordance with one preferred embodiment of the present invention, when the recording signal is a signal of an alternating current or an symmetric alternating current biased to the negative polarity side, a dielectric layer comprising a dielectric substance having an electron-acceptive property is used as the dielectric layer and when the recording signal is a signal of an asymmetric alternating current biassed to the positive polarity side, a dielectric layer comprising a dielectric substance having an electron-donative property is used as the dielectric layer, whereby the image density can be further enhanced.

In conventional electrostatic recording processes, since the dielectric layer as the recording layer has such a polarity that it is electrically charged by friction, the polarity of the dielectric layer is made opposite to the polarity of the recording voltage. More specifically, in case of the negative recording voltage, the charge row of the dielectric layer is made positive (electron-donative) and in case of the positive recording voltage, the charge row of the dielectric layer is made negative (electron-acceptive), so that occurrence of fogging may be prevented. However, in such arrangement, a charge of a polarity reverse to the polarity of the recording voltage is induced by friction of the dielectric layer at the recording or developing step, whereby the recorded surface potential is reduced and the image density is lowered. In contrast, according to the above preferred embodiment of the present invention, since an alternating current or asymmetric alternating current is used for the recording signal, even if the polarity of the recording voltage is in agreement with the polarity of the charge row of the dielectric layer, a weak charge of the same polarity as that of the recording voltage, which is generated by friction and causes fogging, can be erased, and therefore, reduction of the recorded surface potential can be effectively prevented.

In the present invention, as the electron-donative dielectric substance, there can preferably be employed, for example, acrylic resins, methacrylic resins, thermoplastic polyesters, acetyl cellulose, polycarbonates and other ester group-containing polymers. As the electron-acceptive dielectric substance, there can preferably be employed, for example, vinyl chloride resins, vinylidene chloride resins, chlorinated polyethylene, chlorinated polyethylene, chlorinated rubbers, vinyl chloride-vinyl acetate-maleic acid copolymers, polyvinyl fluoride, tetrafluoroethylene-hexafluoropropylene copolymers and other halogen-containing polymers.

Recording Process

Referring now to FIGS. 3-A, 3-B and 3-C illustrating the steps of the process of the present invention, an output device 13 for transmitting an alternating recording signal, namely a high frequency signal formed by amplifying and modulating an image signal, is connected to a recording electrode (recording stylus) 11 and a counter electrode 12. Between the electrodes 11 and 12, an electrostatic recording material 14 is disposed so that it is electrically connected to the electrodes 11 and 12. As described hereinbefore, the electrostatic recording material 14 comprises a dielectric layer 15 and an electroconductive substrate 16, which are disposed in a specific arrangement, and the electroconductive substrate 16 is located in contact with or in the vicinity of the counter electrode 12 and the dielectric layer 15 is located in contact with or in the vicinity of the recording electrode 11. By relatively moving the recording electrode 11 and the electrostatic recording material 14 and applying an alternating recording signal between the two electrodes 11 and 12, an electrostatic latent image 17 is formed on the dielectric layer 15.

At the subsequent developing step shown in FIG. 3-B, the electrostatic latent image 17 formed on the electrostatic recording material 14 is developed with a known developer 18. In general, this developer 18 is held in the form of a magnetic brush on a developing roller 19 singly or in combination with a magnetic carrier, and when a spike of the magnetic brush falls in contact with the surface of the dielectric layer of the electrostatic recording material 14, a visible toner image 20 is formed.

At the final fixing step shown in FIG. 3-C, the electrostatic recording material 4 having the visible toner image 20 formed thereon is fed between a pair of press rollers 21 and fixation of the visible toner image 20 is performed under pressure to form a fixed image 22.

In the present invention, a recording signal consisting of a high frequency alternating current or asymmetric alternating current formed by amplifying and modulating an image signal can be synthesized according to any optional means.

For example, a recording signal of an alternating current having a wave form as shown in FIG. 4-A can be synthesized by modifying an image signal 23 by a carrier wave oscillator 24 and a modulator 25 and amplifying the modulated signal by an amplifier 26 in an output circuit shown in FIG. 4-B, and the so synthesized recording signal is applied to a recording electrode 11.

A recording signal of an asymmetric alternating current having a wave form biased to the negative polarity side as shown in FIG. 5-A is synthesized by transmitting a modulated signal from the amplifier 26 to a transformer 27 and deviating it to the negative polarity side by a diode 28 and a power source 29 in an output circuit 5-B.

A recording signal of an asymmetric alternating current having a wave form biased to the positive polarity side as shown in FIG. 6-A is synthesized by an output circuit shown in FIG. 6-B in which the polarity connection between the diode 28 and power source 29 is made reverse to that shown in FIG. 5-B.

The frequency of the carrier wave of the high frequency signal is not particularly critical in the present invention so far as charges are generated on the dielectric material layer. In general, a high frequency of 5 to 200 KHz is advantageously selected and used depending on the scanning speed adopted for recording. The voltage to be applied is appropriately chosen within the range of 220 to 1500 V r.m.s., especially 250 to 1300 V r.m.s., depending on the kind and thickness of the dielectric material layer.

Also the wave form of the carrier wave is not particularly critical in the present invention, and not only a sine wave but also a rectangular wave, a chopping wave and a saw tooth wave can be used in the present invention.

In the present invention, by using a recording signal of an alternating current or asymmetric alternating current, weak charges causing blurring, tailing and fogging on non-image areas (background) can be cancelled out, whereby contamination of the background can be eliminated and the image sharpness can be improved. Further, white spots formed on the image, i.e., so-called dots, can be reduced and such troubles as Moire can be effectively prevented from occurring.

When the recording speed is low, one stylus can be used as the recording electrode (recording stylus), but when the recording speed is high, electrodes arranged in one line or a plurality of lines (pin electrodes and pin matrix electrodes) and letter type electrodes can be preferably employed.

Relative scanning of the recording electrode and the recording material can be accomplished by any of known scanning methods, for example, a cylinder-rotating scanning method, a disc-rotating scanning method, a belt-driving scanning method, a spiral cylinder-rotating scanning method and a recording head array subsequent change-over scanning method. These scanning methods are described in detail in the report of Mr. Yoshida published in Image Techniques, August 1971, pages 56 to 66.

The speed for relative scanning of the recording electrode and the recording material is varied depending on the frequency of the carrier wave of the high frequency recording signal, but in general, it is preferably chosen within the range of 0.5 to 100 m/sec, especially 1 to 50 m/sec.

The formed electrostatic latent image may be developed according to known developing methods by using known developers such as liquid developers, mist developers and dry developers of the one-component and two-component types. In order to obtain images free of Moire and having a good contrast, it is preferred to use a dry developer of the one-component type (electroconductive magnetic developer) comprising 100 parts by weight of a finely divided magnetic material, 10 to 150 parts by weight, especially 25 to 100 parts by weight, of a binder and 1 to 30 parts by weight, especially 3 to 20 parts by weight, of a conducting agent. As the binder, there are preferably employed resins and mixtures comprising 55 to 95% by weight of a resin and 5 to 45% by weight of a wax. Of course, the developer that can be used in the present invention is not limited to the above magnetic developer.

The electric recording process of the present invention can be advantageously applied to facsimile, electrostatic printing, a printer of a computor and the like, and it provides an effect of forming at high speeds recorded images free of such defects as blurring, tailing, fogging and Moire.

The present invention will now be described by reference to the following Examples that by no means limit the scope of the invention.

EXAMPLE 1

A conductor solution formed by mixing at a weight ratio of 7.5 : 2.5 a 10% aqueous solution of an anionic electroconductive resin (Oligo-Z manufactured by Tomoegawa Seishi) and a 10% aqueous solution of a water-soluble acetal resin (Slec-W manufactured by Sakisui Kagaku Kogyo) was coated and dried on the felt side of a high quality paper (having a thickness of 80$\mu$) as a porous substrate. A conductor solution comprising a mixture of a cationic electroconductive resin (ECR-34 manufactured by Dow Chemical) and the same water-soluble acetal resin as mentioned above was coated and dried on the wire side of the substrate. The thickness of each dried coating was about 4$\mu$.

A toluene solution of an acrylic resin (Acrydic 1027 manufactured by Dainippon Ink Kagaku) was coated and dried on the anionic electroconductive resin layer of the substrate to form a dielectric layer having a thickness of 8 $\mu$. The so formed recording paper was attached to a metal drum and a symmetric alternating current of 1200 $V_{p-p}$ having a frequency of 10 KHz was applied at a temperature of 25° C. and a relative humidity of 63% for 90 seconds under the following recording conditions:

Recording speed: 2.0 m/sec

Line density: 13 lines/mm

Stylus pressure: 10 g Then, the recording paper was dipped for 5 seconds in a commercially available liquid developer for negative charging (manufactured by Mita Kogyo) to effect development, and it was then air-dried and the reflection density was measured. The above test was conducted on comparative recording papers formed by coating the cationic electroconductive resin or anionic electroconductive resin alone and by disposing the dielectric layer on the cationic electroconductive resin layer of the above-mentioned coated substrate, and the reflection density was determined in each case. Obtained results are shown in Table 1-A.

Table 1-A

| Resin Combination | Reflection Density |
|---|---|
| cationic-cationic | 0.80 |
| anionic-anionic | 0.80 |
| cationic-anionic | 0.76 |
| anionic-cationic | 0.98 |

In Table 1-A, the underlined resin is one on which the dielectric layer was formed.

From the results shown in Table 1-A, it will readily be understood that when a dielectric layer is formed on an anionic electroconductive resin layer of a substrate having both the anionic and cationic electroconductive resins coated on both the surfaces thereof, respectively, a recorded image of a higher density can be obtained.

The above-mentioned test was conducted at a temperature of 20° C. and a relative humidity of 40%, and the reflection density was determined to obtain results shown in Table 1-B.

Table 1-B

| Resin Combination | Reflection Density |
|---|---|
| cationic-cationic | 0.60 |
| anionic-anionic | 0.50 |
| cationic-anionic | 0.45 |
| anionic-cationic | 0.87 |

From the results shown in Table 1-B, it will readily be understood that when a dielectric layer is formed on an electroconductive substrate according to the present invention, the recording characteristics under low humidity conditions can be remarkably improved.

EXAMPLE 2

Four electroconductive substrates similar to those prepared in Example 1 were prepared in the same manner as in Example 1 except that Conductive Polymer 261-LVF (manufactured by Sanyo Kasei Kogyo) was used as the cationic electroconductive resin instead of ECR-34. A toluene solution of a styrene-acrylic acid ester copolymer (Pliolite CPR manufactured by Goodyear) was coated and dried on the coated substrate to form a dielectric layer having a dry thickness of 6 $\mu$. An asymmetric alternating current formed by overlapping an alternating current of 800 $V_{p-p}$ and 10 KHz on a positive direct current voltage of 200 V was applied as the recording voltage to effect recording in the same manner as in Example 1, and after recording, development was carried out by using an electroconductive powdery developer comprising a finely divided magnetic material (developer for heat fixation manufactured by Mita Kogyo). After heat fixation, the reflection density was determined to obtain results shown in Table 2.

Table 2

| Resin Combination | Reflection Density |
|---|---|
| cationic-cationic | 0.67 |
| anionic-anionic | 0.64 |
| cationic-anionic | 0.88 |
| anionic-cationic | 0.62 |

From the results shown in Table 2, it will readily be understood that in an electroconductive substrate coated with an anionic electroconductive resin and a cationic electroconductive resin, when a dielectric layer is formed on the side of the cationic electroconductive resin, a recorded image having a higher density can be obtained.

EXAMPLE 3

In the same manner as described in Example 1, four electroconductive substrates were prepared by using an aqueous solution of a cationic electroconductive resin (Elecond PQ-10W manufactured by Soken Kagaku) and polyvinyl alcohol and an aqueous solution of an anionic electroconductive resin (Chemistat 6120 manufactured by Sanyo Kasei Kogyo) and polyvinyl alcohol. A tetrahydrofuran solution of a chlorinated rubber (CR-40 manufactured by Asahi Denka Kogyo) was coated and dried on each substrate to form a dielectric layer having a dry thickness of 5 $\mu$. The so prepared recording paper was attached to a metal drum and a symmetric alternating current (1400 $V_{p-p}$) having a frequency of 50 KHz was applied for 90 seconds under the following recording conditions:

Recording speed: 3 m/sec
Line density: 10 lines/mm
Stylus pressure: 15 g

After recording, development was carried out by using an electroconductive magnetic powdery developer for pressure fixation (manufactured by Mita Kogyo) and after pressure fixation, the reflection density was determined to obtain results shown in Table 3.

Table 3

| Resin Combination | Reflection Density |
|---|---|
| cationic-cationic | 0.90 |
| anionic-anionic | 1.22 |
| cationic-anionic | 0.88 |
| anionic-cationic | 1.36 |

From the results shown in Table 3, it will readily be understood that in an electroconductive substrate treated with an anionic electroconductive resin and a cationic electroconductive resin, when a dielectric layer is coated on the side treated with the anionic electroconductive resin according to the present invention, a recorded image of a higher density can be obtained.

EXAMPLE 4

In the same manner as described in Example 1, four electroconductive substrates were prepared by using an aqueous solution of a cationic electroconductive resin (Chemistat 6200 manufactured by Sanyo Kasei Kogyo) and polyvinyl alcohol and an aqueous solution of an anionic electroconductive resin (Elcond A-3 manufactured by Soken Kagaku) and polyvinyl alcohol.

A toluene solution of an acrylic resin (Dianal LR-297 manufactured by Mitsubishi Rayon) was coated and dried on each substrate to form a dielectric layer having a dry thickness of 7 $\mu$. An asymmetric alternating current formed by overlapping an alternating current voltage of 900 $V_{p-p}$ and 30 KHz on a positive direct current voltage of 200 V was applied as the recording voltage and recording was carried out for 90 seconds under the following conditions:

Recording speed: 3 m/sec
Line density: 6 lines/mm
Stylus pressure: 10 g

After recording, development was carried out according to the magnetic brush development method using a dry powdery developer for positive charging and heat fixation was then conducted. The reflection density of the resulting image was determined to obtain results shown in Table 4.

Table 4

| Resin Combination | Reflection Density |
|---|---|
| cationic-cationic | 1.05 |
| anionic-anionic | 0.70 |
| cationic-anionic | 1.20 |
| anionic-cationic | 0.95 |

From the results shown in Table 4, it will readily be understood that in an electroconductive substrate treated with an anionic electroconductive resin and a cationic electroconductive resin, when a dielectric layer is formed on the side treated with the cationic electroconductive resin according to the present invention, a recorded image having a higher density can be obtained.

EXAMPLE 5

An electrostatic recording paper prepared in Example 2 (the cationic-anionic combination in Table 2 in which the dielectric layer was formed on the cationic resin side) was pasted on a signal receiving drum and a test chart No. 2 specified by the Academic Society of Images and Electronics was set to a signal emitting drum. The recording operation was carried out by applying a recording voltage transmitted from a record signal output zone capable of overlapping an amplified modulated wave to a positive direct current voltage of 200 V to a recording stylus and scanning the recording stylus on the recording paper. The stylus used was a tungsten stylus having a diameter of 150 $\mu$, and the stylus pressure was 10 g. The line density was 10 lines per mm, and the frequency of the carrier wave was 10 KHz. The recording speed was 3.5 m/sec.

After the above recording operation, development was carried out by using an electroconductive magnetic powdery developer for heat fixation and the developed image was heat-fixed to obtain a recorded image free of blurring, tailing, fogging and Moire and having a high density (reflection density = 1.3).

EXAMPLE 6

An electrostatic recording paper prepared in Example 1 (the anionic-cationic combination shown in Table 1 in which the dielectric layer was formed on the anionic resin side) was pasted on a signal receiving drum, and the recording operation was carried out under the same conditions as in Example 5 except that an amplified and modulated wave was overlapped on a negative direct current voltage of 200 V. After the recording operation, development was carried out by using a liquid developer for negative charging and the developed image was heat-fixed by warm air. A recorded image free of tailing, blurring and fogging and having a high density (reflection density = 1.2) was obtained.

What we claim is:

1. An alternating current electrostatic recording process comprising relatively scanning a recording electrode on an electrostatic recording material which is electrically connected between said recording electrode and a counter electrode, applying a high frequency alternating current recording signal formed by modulating an image signal by a high frequency carrier wave between said two electrodes to form an electrostatic image on the electrostatic recording material, developing the so formed electrostatic image with a developer and fixing the developed image, said process being characterized in that said electrostatic recording material comprises an electroconductive layer and a dielectric layer, said electroconductive layer includes a porous substrate, a cationic electroconductive resin layer predominantly distributed on one surface of said porous substrate, an anionic electroconductive resin layer predominantly distributed on the other surface of said porous substrate and a layer of a polycomplex of the cationic electroconductive resin and the anionic electroconductive resin impregnated in said substrate and interposed between said two electroconductive resin layers, and that the dielectric layer is disposed on the side of the anionic electroconductive resin layer.

2. An alternating current electric recording process according to claim 1 wherein a carrier wave of said recording signal has a frequency of 5 to 200 KHz.

3. An alternating current recording process according to claim 1 wherein said electroconductive layer is one prepared by coating or impregnating one surface of a porous substrate with a cationic electroconductive resin and coating or impregnating the other surface of the porous substrate with an anionic electroconductive resin.

4. An alternating current electric recording process according to claim 1 wherein said electroconductive layer is one formed by coating or impregnating one surface of a porous substrate impregnated with an organic moisture-absorbing substance, with a cationic electroconductive resin and coating or impregnating the other surface of said porous substrate with an anionic electroconductive resin.

5. An alternating current electric recording process according to claim 1 wherein the dielectric layer is one composed of a dielectric substance having an electron-acceptive property.

6. An alternating current recording process according to claim 1 wherein said electroconductive layer is one formed by coating or impregnating one surface of a porous substrate impregnated with a water-soluble inorganic salt, with a cationic electroconductive resin and coating or impregnating the other surface of said porous substrate with an anionic electroconductive resin.

7. An electrostatic recording process comprising relatively scanning a recording electrode on an electrostatic recording material which is electrically connected between said recording electrode and a counter electrode, applying a high frequency asymmetric alternating current recording signal formed by modulating an image signal by a high frequency carrier wave between said two electrodes to form an electrostatic image on the electrostatic recording material, developing the so formed electrostatic image with a developer and fixing the developed image, said process being characterized in that said electrostatic recording material comprises an electroconductive layer and a dielectric layer, said electroconductive layer includes a porous substrate, a cationic electroconductive resin layer predominantly distributed on one surface of said porous substrate, an anionic electroconductive resin layer predominantly distributed on the other surface of said porous substrate and a layer of a polycomplex of the cationic electroconductive resin and the anionic electroconductive resin impregnated in said substrate and interposed between said two electroconductive resin layers.

8. An electrostatic recording process according to claim 7 wherein the recording signal is a signal of an asymmetric alternating current biased to the negative polarity side and the dielectric layer is disposed on the side of the anionic electroconductive resin layer.

9. An electrostatic recording process according to claim 8 wherein the dielectric layer is comprised of a dielectric substance having an electron-acceptive property.

10. An electrostatic recording process according to claim 7 wherein the recording signal is a signal of an asymmetric alternating current biased to the positive polarity side and the dielectric layer is disposed on the side of the cationic electroconductive resin layer.

11. An electrostatic recording process according to claim 10 wherein the dielectric layer is comprised of a dielectric substance having an electron-donative property.

12. An electrostatic recording process according to claim 7 wherein a carrier wave of said recording signal has a frequency of 5 to 200 KHz.

13. An alternating current recording process according to claim 7 wherein said electroconductive layer is one prepared by coating or impregnating one surface of a porous substrate with a cationic electroconductive resin and coating or impregnating the other surface of the porous substrate with an anionic electroconductive resin.

14. An electrostatic recording process according to claim 7 wherein said electroconductive layer is one formed by coating or impregnating one surface of a porous substrate impregnated with an organic moisture-absorbing substance, with a cationic electroconductive resin and coating or impregnating the other surface of said porous substrate with an anionic electroconductive resin.

15. An electrostatic recording process according to claim 7 wherein said electroconductive layer is one formed by coating or impregnating one surface of a porous substrate impregnated with a water-soluble inorganic salt, with a cationic electroconductive resin and coating or impregnating the other surface of said porous substrate with an anionic electroconductive resin.

* * * * *